United States Patent [19]

Adamowski

[11] 4,298,054

[45] Nov. 3, 1981

[54] METHOD OF WITHDRAWING A MOBILE SENSOR FROM A HEAT EXCHANGER

[75] Inventor: Andrev Adamowski, Paris, France

[73] Assignee: Intercontrole S.A., Rungis, France

[21] Appl. No.: 115,240

[22] Filed: Jan. 25, 1980

[30] Foreign Application Priority Data

Feb. 5, 1979 [FR] France ..... 79 03408

[51] Int. Cl.[3] ..... F28F 11/00

[52] U.S. Cl. ..... 165/1; 165/11 A; 376/245

[58] Field of Search ..... 165/11 A, 1; 176/19 R

[56] References Cited

U.S. PATENT DOCUMENTS

| | | | |
|---|---|---|---|
| 3,934,731 | 1/1976 | Muller et al. | 176/19 R X |
| 4,070,561 | 1/1976 | Shunichi et al. | 165/11 A X |
| 4,149,932 | 4/1979 | Jacobs et al. | 176/19 R X |
| 4,172,402 | 10/1979 | Abell et al. | 165/11 A |
| 4,205,939 | 6/1980 | Reyes | 165/11 A X |

FOREIGN PATENT DOCUMENTS

| | | | |
|---|---|---|---|
| 2831822 | 7/1979 | Fed. Rep. of Germany | 165/11 A |

*Primary Examiner*—Albert W. Davis
*Assistant Examiner*—Margaret A. Focarino
*Attorney, Agent, or Firm*—Karl F. Ross

[57] ABSTRACT

A method of withdrawing a mobile inspection sensor assembly from the lower header of a vertical tubular heat-exchanger includes the steps of introducing into a guide tube of the assembly and into a water tube of the heat-exchanger aligned therewith an end portion of a dummy sensor in the form of a tube of a relatively rigid material, which may nevertheless be slightly bent, securing the end of the dummy sensor to the water tube by actuating means operable at the other end of the sensor tube, and sliding the sensor assembly along the tube of the dummy to an access opening of the header.

A dummy sensor for carrying out this method includes an expansible head which may be mechanically or pneumatically operated to fix the sensor in a water tube.

8 Claims, 4 Drawing Figures

METHOD OF WITHDRAWING A MOBILE SENSOR FROM A HEAT EXCHANGER

BACKGROUND OF THE INVENTION

1. Field of the Invention

This invention relates to a method of removing a mobile sensor apparatus from the header of a tubular heat-exchanger and returning the apparatus to its original position. The invention also relates to a device for carrying out this method.

2. Summary of the Prior Art

It is necessary to inspect the water tubes of vertical heat-exchangers employed in nuclear-powered generating stations. It is, in practice, essential that the water constituting the primary fluid and contaminated by nuclear reactions should not pass into the secondary fluid which is employed to drive a turbo-alternator. This inspection is effected by means of an eddy current sensor which is passed through each of the tubes; a crack or a hole in the tube or even a simple reduction in the thickness of the latter then becomes apparent as a change in the output current of the sensor.

In practice, the sensor is carried by a mobile apparatus disposed in the lower header of the heat-exchanger into each of which these tubes open. This mobile apparatus is secured to the heat-exchanger structure with the aid of expansible mandrels which are introduced into it and which are secured within the tubes of the tube bundle, and carries a guide tube which lies opposite another tube of the bundle and into which the eddy current sensor is introduced. After having inspected one tube, the sensor is retracted from the tube, the apparatus is moved a distance equal to the spacing between two tubes and the sensor is introduced into a fresh tube. These various operations are controlled externally since the wall of the header having been in contact with the irradiated water itself emits dangerous radiation.

If a fault occurs in the sensor apparatus preventing its displacement, a repair man must then enter the header in order to overcome the fault. To do this, it is necessary to provide protective clothing and make use of a face mask, and, despite this, no one can remain in the header except for a very short period, of the order of three minutes. This poses a serious problem, since it may be either that the repair requires more than three minutes, or that there are no repair men authorized to enter the chamber.

An object of the present invention is to provide a method and an apparatus by which it is possible to retrieve the mobile sensing apparatus from the lower header of a tubular heat-exchanger without having to enter that header.

SUMMARY OF THE INVENTION

According to the present invention there is provided a method of withdrawing a mobile sensor apparatus from a header of a tubular heat-exchanger, the heat-exchanger having a closable access opening and the sensor apparatus having expansible mandrels by which the apparatus can be secured to tubes of the heat-exchanger and at least one guide tube by which a sensor can be introduced into a tube of the heat-exchanger to be inspected, said method comprising the steps of introducing into one said guide tube and a tube of the heat-exchanger aligned therewith a dummy sensor mounted on a slightly flexible tube and carrying means by which it can be temporarily fixed within the heat-exchange tube, fixing the dummy sensor within the said heat-exchanger tube, releasing the expansible mandrels of the sensor apparatus, and sliding the apparatus along the tube of the dummy sensor to the access opening.

DESCRIPTION OF THE PREFERRED EMBODIMENT

Figure 1:
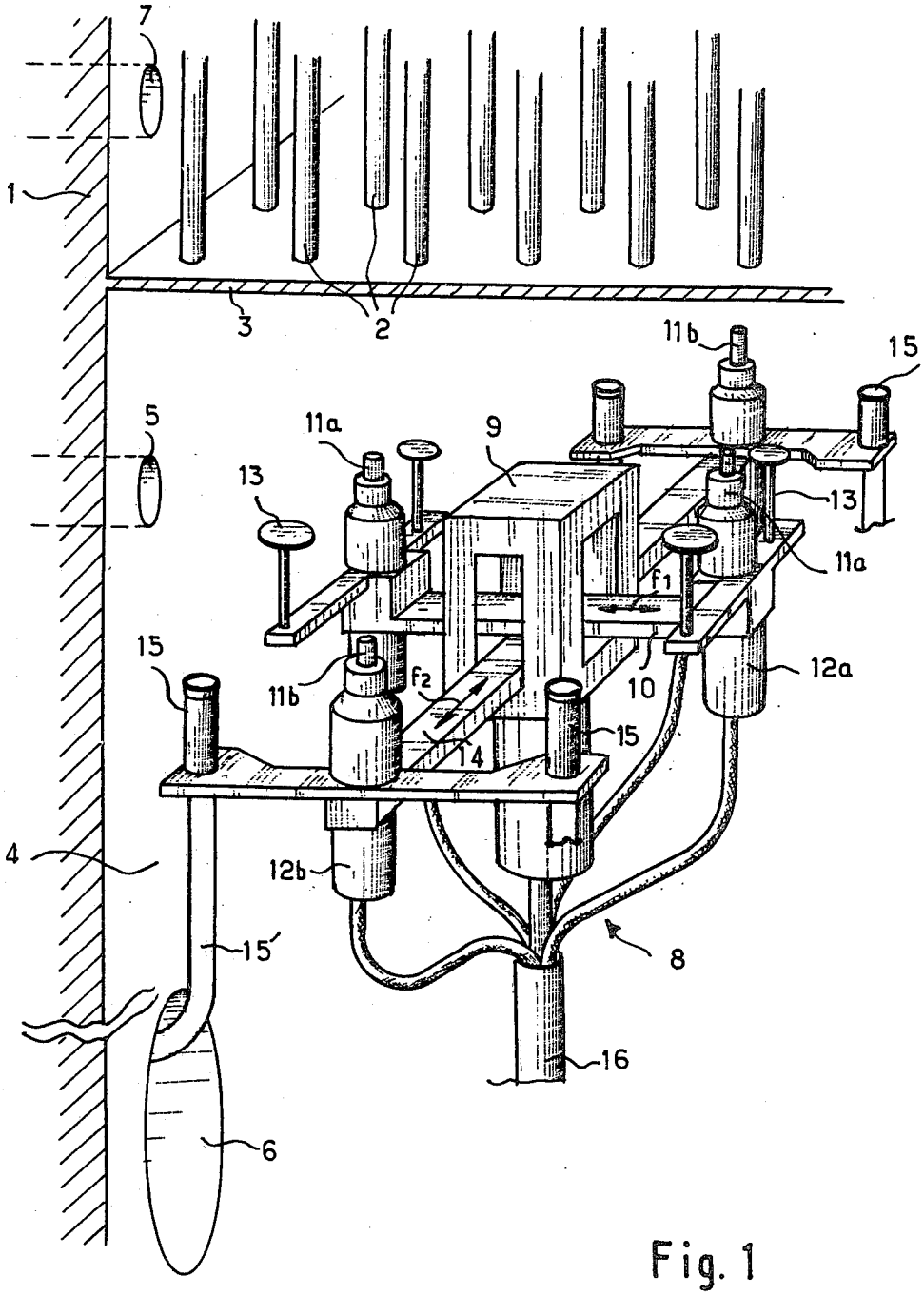
FIG. 1 is a diagrammatic perspective view showing a mobile sensor disposed in the lower header of a tubular exchanger.

Referring to FIG. 1, a vertical heat-exchanger 1 has water tubes 2 of which the ends are secured in plates, the lower plate being shown at 3. At each end, the tubes 2 open into headers of which the lower header is indicated at 4 and is connected to a water inlet or outlet passage 5. The header 4 is provided with an access opening 6 normally closed in a fluid-tight manner. An inlet or outlet duct 7 is provided for secondary fluid.

A mobile sensing apparatus 8 is disposed within the header and is normally secured to the wall 3 but, for clarity in the drawing, it is shown spaced therefrom.

The apparatus 8 comprises a frame 9 with respect to which a transverse member 10 is movable both longitudinally as indicated by the arrow $f_1$ and vertically. At each end, the transverse member 10 carries an expansible mandrel 11*a* which can be controlled by a respective hydraulic actuator 12*a* and on each side thereof there are two abutments 13.

A second transverse member 14, extending perpendicularly to the transverse member 9, is movable both longitudinally as indicated by the arrow $f_2$ and vertically. The transverse member 14 carries two expansible mandrels 11*b*, which can be controlled by respective hydraulic actuators 12*b*, and on either side of each of which mandrels there are two guide tubes 15. The tubes 15 are spaced from the respective mandrel 11*b* by a distance equal to that separating two adjacent tubes 2. The tubes 15 are connected to tubes 15' passing through the opening 6.

Under normal conditions, the apparatus 8 is secured to the tubular plate 3, the mandrels 11*a* and 11*b* being engaged in tubes 2 and expanded in a manner such as to press on the inner face of these tubes. An eddy current sensor is then introduced into a guide tube 15 which lies opposite a tube 2 and then inspection of the tube 2 is carried out.

While this inspection is effected, the mandrels 11*b*, for example, are released, the transverse member 14 is lowered and it is moved in the direction of the arrow $f_2$ so that the mandrels of one at least of the guide tubes 15 lies opposite the tubes 2; the transverse member 14 is raised again so that the mandrels engage again in the tubes 2 and expansion of the mandrels is effected. Then the mandrels 11*a* are released, the transverse member 10 is lowered, the whole of the apparatus is then moved in the predetermined direction of movement of the transverse member 14, the transverse member 10 is raised again and the mandrels 11*a* are refixed in position. It remains only to inspect that one of the tubes which then lies opposite to one of the guide tubes 15. All these operations are controlled remotely from a control station disposed outside the exchanger 1, the various conductors and supply ducts for the hydraulic actuator fluid being grouped in a tube 16 which traverses in a fluid-tight manner, the closure cover (not shown) of the access opening 6.

If the apparatus 8 develops a fault, a dummy sensor is introduced into the chamber 4 through the access opening 6; this dummy sensor being made to pass within a guide tube 15 lying opposite to one water tube 2, and this dummy sensor is secured to that tube 2.

Figure 2:
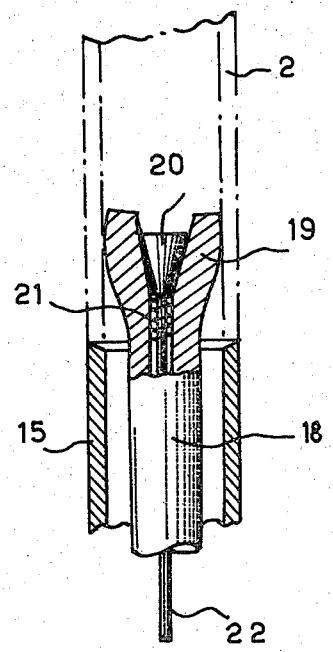
FIG. 2 shows, in longitudinal section, a first embodiment in accordance with the invention of a dummy sensor.

In the embodiment of FIG. 2, the dummy sensor is constituted by a relatively rigid tube 18, but capable of following a curve, at one of the ends of which is secured an expansible split tube 19 of which the various elements can be spaced from one another by a cone 20; the latter can be displaced against the action of the spring 21 in the direction corresponding to the expansion of the shaft, by a cable 22 extending through the interior of the tube 18 and can be actuated at the end of this tube opposite to the tube. When the tube is engaged in the end of one of the tubes 2, it is sufficient to exert a tractive force on the cable 22 in order to engage the expansible tube in the tube 2.

Figure 3:
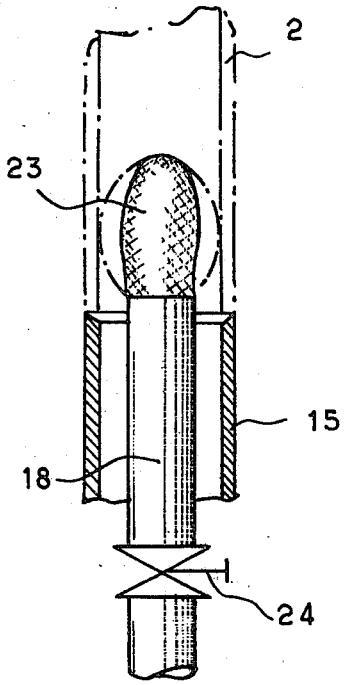
FIG. 3 shows a second embodiment of dummy sensor.

In the embodiment of FIG. 3, the tube 18 carries at its end a dilatable bulb 23 projecting from the tube and connected at its other end to a fluid pressure source through the intermediary of a valve 24. When the bulb 23 is introduced into the tube, the valve 24 is opened so that the bulb dilates, which serves to fix the tube 18 within the tube 2.

Figure 4:
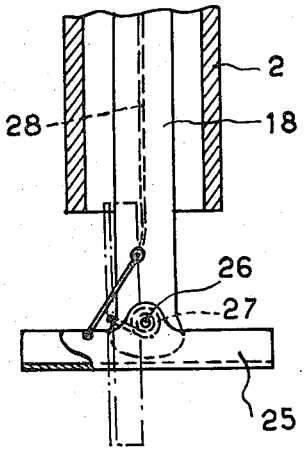
FIG. 4 shows a third embodiment of dummy sensor.

In the embodiment of FIG. 4, the tube 18 carries at its end a boss on which a locking arm 25 is pivotally mounted at 26. This arm is of channel shape so that it can take up a retracted position in which it is applied against the tube 18. A spring 27 tends to bring it into a position in which it is perpendicular to the tube. A cable 28 which passes through the tube 18 and of which the end is secured to the arm 25, enables the arm to be held in the retracted position.

The dummy sensor of FIG. 4 is threaded through the whole length of the tube until it leaves at the other end of the latter. By manipulation of the cable 28, the arm 25 is released which pivots and becomes disposed transversely, which prevents it from re-entering the tube 2. The dummy sensor is thus immobilised with respect to the tube. When the dummy sensor has been secured to a tube 2, the mandrels 11*a* and 11*b* are released. The apparatus 8 is then released from the plate 3 and slides along the tube 18 which leads to the opening 6 by which it can then be extracted for repair. During this operation the tube 15' slides on the tube 18 and the rate of descent of the apparatus can be controlled by acting on the tube 15'.

The dummy sensors can also be used to return the apparatus 8 to its original condition. In this case, the dummy sensors are secured as shown in FIGS. 2, 3 and 4, within four tubes 2 of which the positions and the spacing correspond to those of four guide tubes 15. It then suffices, the apparatus 8 lying outside of the chamber 4, to thread the tubes 18 of these dummy sensors into the guide tubes 15 and to push on the tube 16 or on the tube 15' in order to bring adjacent to the plate 3, the apparatus 8 of which the mandrels 11*a* and 11*b* engage in the tubes 2, and to effect the expansion of the mandrels.

I claim:

1. A method for withdrawing a mobile sensor apparatus from a header of a tubular heat-exchanger, the heat-exchanger having a closable access opening and the sensor apparatus having expansible mandrels by which the apparatus can be secured to tubes of the heat-exchanger and at least one guide tube by which a sensor can be introduced into a tube of the heat-exchanger to be inspected, said method comprising the steps of introducing into one said guide tube and a tube of the heat-exchanger aligned therewith a dummy sensor mounted on a slightly flexible tube and carrying means by which it can be temporarily fixed within the heat-exchanger tube, fixing the dummy sensor within the said heat-exchanger tube, releasing the expansible mandrels of the sensor apparatus, and sliding the apparatus along the tube of the dummy sensor to the access opening.

2. A method according to claim 1, wherein the dummy sensor is mechanically expansible to grip the interior of a heat-exchanger tube.

3. A method according to claim 1, wherein the dummy sensor is pneumatically inflatable.

4. In sensor apparatus for use in a tubular heat-exchanger, framework means, expansible mandrels mounted on the framework means and intended to engage in water tubes of the heat-exchanger, at least one guide tube to enable a sensor to be introduced into a water tube of the heat-exchanger, and a dummy sensor which can be introduced through a said guide tube into a water tube, said dummy sensor having a slightly flexible mounting tube providing a support therefore, means at one end for engaging the interior of the wall of a water tube, and control means passing through the mounting tube for controlling the engagement means, said dummy sensor enabling, when it is engaged in a water tube, withdrawal of the apparatus through an access opening of the heat-exchanger.

5. Apparatus according to claim 4, wherein the dummy sensor engaging means comprises an expansible end tube and spring-loaded conical means for controlling the expansion of the shaft.

6. Apparatus according to claim 4, wherein the dummy sensor engaging means comprises a dilatable bulb at the end of the mounting tube and a valve for controlling dilation of the bulb.

7. Apparatus according to claim 4, wherein the dummy sensor engaging means comprises a pivoted channel-section member and means for controlling its orientation relative to the end of the sensor whereby the member can be arranged transversely of a water tube to hold the sensor firmly relative to the water tube.

8. A method for returning a mobile sensor apparatus to a header of a water-tube heat-exchanger having an access opening, said sensor apparatus including a framework carrying expansible mandrels by which the apparatus can be fixed to water-tubes of the exchanger and at least one guide tube for the introduction of a sensor to one of the water tubes, said method comprising the steps of passing a dummy sensor through one of the guide tubes, engaging the dummy sensor in one of the water-tubes sliding the apparatus along the dummy sensor until the expansible mandrels engage in water tubes, and withdrawing the dummy sensor from the guide tube.

* * * * *